United States Patent [19]

Bickham

[11] Patent Number: 4,720,106

[45] Date of Patent: Jan. 19, 1988

[54] VIBRATION DAMPENING DEVICE FOR ATTACHMENT TO A RACKET

[76] Inventor: Lane A. Bickham, Box 802, Tomball, Tex. 77375

[21] Appl. No.: 854,550

[22] Filed: Apr. 16, 1986

[51] Int. Cl.[4] ..... A63B 49/00

[52] U.S. Cl. ..... 273/73 R

[58] Field of Search ..... 273/73 R, 73 J, 75, 273/189 R, 189 A, 183 B, 185 D, 29 R, 29 A, 67 R, 188 R, 188 A, 81 R, 81 D, 165, 166, 190 R, 190 A, 81 C, 81.3, 186 R, 185 C; 248/288.3; 403/167, 168, 76, 77, 90, 143, 137

[56] References Cited

U.S. PATENT DOCUMENTS

| | | | |
|---|---|---|---|
| 739,450 | 9/1903 | Schnek . | |
| 1,655,092 | 1/1928 | Davis | 273/189 R |
| 2,189,997 | 2/1940 | Salem . | |
| 2,273,416 | 2/1942 | Norwood . | |
| 3,203,697 | 8/1965 | Berzatzy . | |
| 3,339,926 | 9/1967 | Coupar . | |
| 3,554,554 | 1/1971 | Zane . | |
| 3,693,973 | 9/1972 | Wattenburg . | |
| 3,712,618 | 1/1973 | Berzatzy . | |
| 3,814,419 | 6/1974 | Bjorklund . | |
| 3,858,881 | 1/1975 | Hurwitz . | |
| 3,937,465 | 2/1976 | Roland . | |
| 4,030,732 | 6/1977 | Vincent . | |
| 4,150,821 | 4/1979 | Racz . | |
| 4,209,169 | 6/1980 | Roberts . | |
| 4,322,077 | 3/1982 | Van't Hof . | |
| 4,348,023 | 9/1982 | Hinson . | |
| 4,445,686 | 5/1984 | Daugherty . | |
| 4,519,608 | 5/1985 | Gilly . | |

FOREIGN PATENT DOCUMENTS

| | | | |
|---|---|---|---|
| 443206 | 2/1936 | United Kingdom | 273/73 J |

*Primary Examiner*—Leo P. Picard
*Assistant Examiner*—Matthew L. Schneider
*Attorney, Agent, or Firm*—Lalos & Keegan

[57] ABSTRACT

A device adapted for use with a racquet having handle, neck and head sections, including a first anchoring portion attachable to a portion of the head section of the racquet, a second anchoring portion attachable to the wrist of a user gripping the handle section of the racquet, and an elongated, rigid member having end portions connected to the anchoring means providing freedom of movement of the wrist except during forehand and backhand strokes of the racquet. The anchoring portions are connected to the elongated rigid member via ball and socket joints. Both the first and second anchoring portions contain dampening material that serves to dampen vibration transmitted from the racquet to the player's arm.

11 Claims, 4 Drawing Figures

VIBRATION DAMPENING DEVICE FOR ATTACHMENT TO A RACKET

This invention relates to a device adapted for use with a racquet such as a tennis racquet, and more particularly to a device for improving the strokes of the user while minimizing the adverse effects of racquet vibrations normally transmitted to the forearm of the user.

In the game of tennis, vibrations caused by the impact of the ball with the strings of a racquet normally are transmitted through the handle of the racquet and the hand and wrist of the player to the forearm where it may cause a condition commonly referred to a tennis elbow. The precise cause of such condition is not entirely understood although it is believed that weak forearm muscles, an improper grip or a tendency to hit the ball incorrectly contribute to tennis elbow. It also is believed that gout and other arthritic diseases, as well as a softening of cartilage in the forearm, a result of the normal aging process, also may contribute to such condition.

There does not appear to be a clear consensus among players, trainers and sports physicians on the most effective method of treating tennis elbow. Physicians often prescribe anti-inflammatory drugs such as aspirin or more potent drugs in more serious cases. The more common remedy, however, is the use of a tight elastic band on the forearm below the elbow, on the theory that compression of the arm decreases the tension of the forearm muscles.

Although many of the remedies for tennis elbow proposed in the past have been effective in providing some relief to players, it has been found that such remedies have not been entirely satisfactory, particularly in instances of severe tennis elbow. It thus has been found to be desirable not only to provide a more effective means to counteract the adverse effects of racquet vibrations which result in either developing tennis elbow or aggravating an existing condition of tennis elbow but also to help improve the playing strokes of the user.

Accordingly, it is the principal object of the present invention to provide a novel device for minimizing the adverse effects of racquet vibrations caused by impacts of a ball with the strings of the racquet.

Another object of the present invention is to provide a novel device for minimizing the transmission of racquet vibrations to the forearm of the user of the racquet.

A further object of the present invention is to provide a novel device adapted for use with a tennis racquet operable to prevent the development or aggravation of the condition known as tennis elbow.

A still further object of the present invention is to provide a device usable with a racquet which is adapted to increase the power and stability of a user's stroke.

Another object of the present invention is to provide a novel device adapted for use with a racquet which provides additional support for the wrist and forearm of the user.

A further object of the present invention is to provide a novel device adapted for use with a racquet which provides unrestricted movement of the wrist except during backhand and forehand strokes under which conditions it provides additional support to the wrist and forearm.

A still further object of the present invention is to provide a novel device adapted for use with a racquet which reduces the degree or firmness of the user's grip of the racquet handle normally required to contend with racquet vibrations.

Another object of the present invention is to provide a novel device adapted for use with a racquet which provides increased power, improved ball control and reduced transmission of vibrations to the foreman of the user.

Other objects and advantages of the present invention will become more apparent to those persons having ordinary skill in the art to which the present invention pertains from the following description taken in conjunction with the accompanying drawings wherein.

Figure 1:
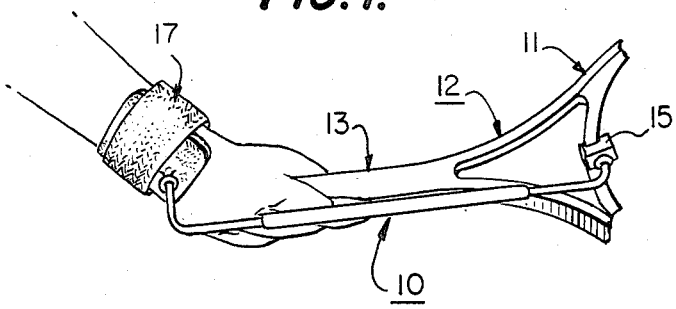
FIG. 1 is a perspective view of an embodiment of the invention shown attached to a tennis racquet and the wrist of a user.

Referring to FIG. 1, there is illustrated a support device 10 having one end thereof attached to a head section 11 of a tennis racquet 12 and an opposite end attached to the wrist of a user gripping handle section 13 of the racquet.

Figure 3:
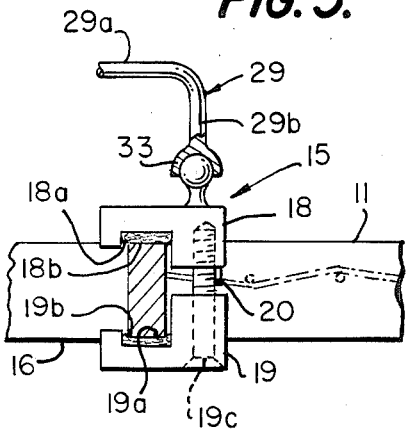
FIG. 3 is an enlarged, vertical cross-sectional view of the means for attaching the device to the head section of the racquet.

Support member 10 includes an elongated, rigid member 14, an assembly 15 for anchoring the device to the head section of the racquet adjacent the neck section 16 thereof, and an assembly 17 for anchoring the device to the wrist of the user. As best shown in FIG. 3, anchoring assembly 15 includes an upper clamping member 18 and a lower clamping member 19. The underside of clamping member 18 is provided with a recess **18*a* which is adapted to receive a portion of the upper side of the head section of the racquet when mounting member 18 is positioned in place on the racquet. Similarly, clamping member 19 is provided with a recess 19*a* on the upper side thereof which is adapted to receive the lower side of a portion of the head section of the racquet when positioned in place in opposed relation to clamping member 18**.

Interposed between the head section of the racquet and clamping members 18 and 19 are strips of cushioning material **18*b* and 19*b*. With the clamping members in position as shown in FIG. 3, the members are urged together and correspondingly clamped to the head section of the racquet adjacent the neck section thereof by means of a threaded fastener extending through an opening 19*c* in clamping member 19 and threaded into an aligned, threaded opening in clamping member 18. Undue clamping action tending to overly compress the cushioning material is prevented by a set of spacer pins 20 mounted on clamping member 18 and engageable with an upper surface of the clamping member 19**.

Figure 2:
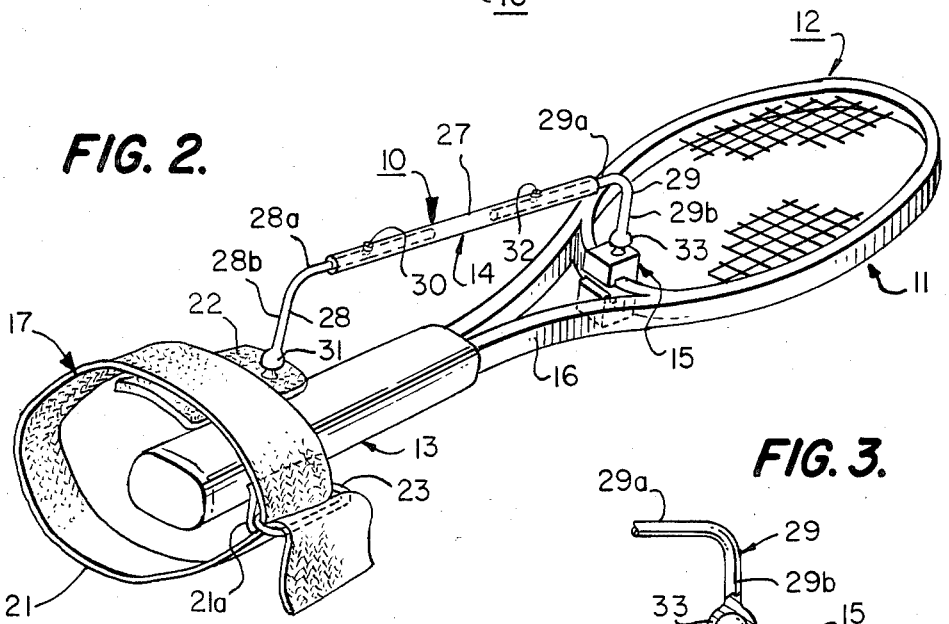
FIG. 2 is an enlarged, perspective view of the embodiment of the invention shown in FIG. 1.
Figure 4:
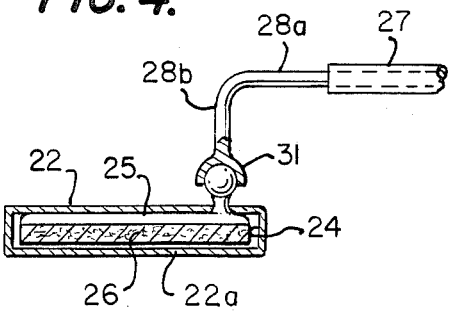
FIG. 4 is an enlarged, vertical cross-sectional view of the means for attaching the device to the wrist of the user.

Referring to FIGS. 2 and 4, anchoring assembly 17 includes a strap 21 and a support pad 22. The strap consists of an elongated piece of fabric having one end turned back and hemmed as at **21*a* and the opposite end passing through a metal retainer 23, in the conventional manner, and having a Velcro-type fastening surface which is adapted to engage and attach to a similar Velcro surface on the outer side of the strap to permit the strap to be placed on the wrist of the user, pulled tightly around the wrist and be secured in place. Support pad 22 preferably also is formed of a fabric, is secured to an inside surface portion of the strap so that it will be interposed between the strap and the wrist of the user when the strap is attached to the wrist of the user, and defines a closed pocket 24. Mounted within the pocket is a rigid pad member 25 and a pad 26 formed of a cushioning material and interposed between the underside of rigid pad 25 and bottom portion 22***a* of pad 22 so that when strap 17 is mounted on the wrist of the user, cushioning pad 26 will be interposed between the strap and the wrist of the user.

Elongated rigid member 14 includes an intermediate, tubular section 27, and a pair of end sections 28 and 29. End section 28 includes a portion 28*a* which is received within tubular section 27 and secured thereto by means of a set screw 30 and a portion 28*b* which is angularly offset approximately 90° relative to portion 28*a* and operatively connected to rigid plate 25 by means of a ball and socket connection 31. Similarly, end section 29 includes a portion 29*a* received within tubular section 27 and secured thereto by means of a set screw 32 and a portion 29*b* which is angularly offset relative to portion 29*a* thereof approximately 90° and operatively connected to clamping member 18 by means of a ball and socket connection 33.

In attaching the support device as described to the racquet and wrist of a user, anchoring assembly 15 is first mounted on the head section of the racquet adjacent the neck section of the racquet as shown in FIG. 2 with the clamping members firmly secured to the head section as shown in FIG. 3. With the strap in an expanded condition and aligned with the handle of the racquet as shown in FIG. 2, the user inserts his hand through the expanded strap and grips the handle of the racquet. The length of the device is then adjusted by loosening one of the set screws and positioning the strap on the wrist. When the strap is thus positioned, the set screw is tightened to fix the length of the support device, and the strap is tightened about the wrist of the user. Under such conditions, the user will have unrestricted wrist movement in any direction except in the directions where the racquet is moved in forehand and backhand strokes.

In the use of the device as described, vibrations caused by the ball hitting the strings of the racquet will be transmitted along two separate paths to the arm of the user. One path consists of the head, neck and handle portions of the racquet and the hand and wrist of the user to the forearm of the user. The second path consists of the head section of the racquet, support device 10 and the wrist of the user to the forearm. Since alternate paths for the transmission of vibrations are provided, fewer vibrations will be transmitted directly from the racquet to the forearm of the user. Those vibrations transmitted through support device 10 further will be minimized by means of the dampening action of cushioning strips 18*b* and 19*b*, the elongation of intermediate section 27 and cushioning pad 26. Accordingly, it will be appreciated that with the use of the support arm as described, the vibrations transmitted from the racquet to the forearm of the user will be appreciably reduced.

In addition to minimizng the amount of vibrations transmitted from the racquet to the forearm of the user, the support device also functions to provide increased power and improved ball control during forehand and backhand strokes of the racquet. During a forehand stroke, the support device is placed in compression, providing increased support and a more rigid racquet. during a backhand stroke, the support device is placed in tension and similarly provides support to the arm and a more rigid racquet for effectively hitting the ball.

Preferably, clamping members 18 and 19, the components of elongated member 27 and pad 25 are formed of rigid yet lightweight materials such as plastic or a light metal such as aluminum, although other suitable materials may be used. It further is preferred that cushioning materials 18*a*, 19*a* and 26 be formed of a material having a modulus of elasticity sufficient to provide a dampening action of the vibrations. It is contemplated that various grades of rubber and similar synthetic materials may be used in this regard.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An attachment for a racquet having handle, neck and head sections comprising a first rigid anchoring means for attaching said attachment to a portion of said head section, a second anchoring means for attaching said attachment to the wrist of a user when the user grips the handle of the racquet, and a rigid, elongated member having end portions universally connected to said first and second anchoring means through ball and joint connections, each of the ball portions of said connections being rigidly secured either to said rigid, elongated member or to one of said anchoring means and each of the socket portions of said connections being rigidly secured to the other of said rigid, elongated member or said anchoring means whereby upon the attachment being worn by a user and a ball being struck by the strings of the racquet, the vibratory forces generated by the strings of the racquet at least partially will be transmitted to the wrist of the user through and be dampened by said rigid, elongated member.

2. An attachment according to claim 1 wherein said rigid, elongated member includes an intermediate section and angularly offset end sections.

3. An attachment according to claim 1 wherein said elongated member is adjustable in length.

4. An attachment according to claim 1 wherein said rigid, elongated member includes an intermediate section and a pair of end sections mountable on and displaceable longitudinally relative to said intermediate section and means for fixing the positions of said end sections relative to said intermediate section.

5. An attachment according to claim 1 including cushioning means for dampening vibration mounted on said first anchoring means and engageable with said head section when said first anchoring means is mounted on said head section.

6. An attachment according to claim 1 including cushioning means interposed between one of said universal connections and said second anchoring means.

7. An attachment according to claim 1 wherein said second anchoring means includes a strap wrapable about the wrist of a user.

8. An attachment according to claim 7 including a cushioning material disposed between one of said universal connections and said strap.

9. An attachment according to claim 1 wherein said first anchoring means includes a pair of clamping members mountable on the head section of the racquet and means for urging said clamping members into clamping engagement with said head section.

10. An attachment according to claim 9 including cushioning means for dampening vibration mounted on at least one of said clamping members whereby upon mounting said first anchoring means on said head section, said cushioning material will be interposed between said one of said clamping members and said head section.

11. An attachment according to claim 1 wherein end portions of said rigid, elongated member, operatively connected to said first and second anchoring means through universal connections, are angularly disposed approximately 90° relative to an intermediate section thereof whereby when the attachment is mounted on a racquet and worn by a user, the wrist of the user will have unrestricted freedom of movement in all directions except in directions of forehand and backhand strokes.

* * * * *